United States Patent [19]

Rhodes

[11] 3,993,125

[45] Nov. 23, 1976

[54] HEAT EXCHANGE DEVICE

[75] Inventor: Eugene E. Rhodes, Belleville, Mich.

[73] Assignee: Ford Motor Company, Dearborn, Mich.

[22] Filed: Nov. 28, 1975

[21] Appl. No.: 636,182

[52] U.S. Cl. ..... 165/153; 29/157.3 B

[51] Int. Cl.[2] ..... F28F 1/22

[58] Field of Search ..... 165/152, 153; 29/157.3 A, 157.3 B; 113/118 A, 118 B

[56] References Cited

UNITED STATES PATENTS

| | | | |
|---|---|---|---|
| 1,257,201 | 2/1918 | Eligh | 113/118 |
| 3,250,325 | 5/1966 | Rhodes et al. | 165/153 |

*Primary Examiner*—Alan Cohan
*Assistant Examiner*—Gerald A. Michalsky
*Attorney, Agent, or Firm*—J. J. Roethel; Keith L. Zerschling

[57] ABSTRACT

A heat exchange device having a vessel and heat transfer core means including at least two tubular conduits in fluid communication with the vessel, the tubular conduits being spaced apart to form an air passageway therebetween. A spacer member is positioned between and in heat exchange relationship with the tubular conduits, the spacer member comprising a unitary strip of metal corrugated or folded back and forth to form a plurality of fin elements each having an essentially planar base member between the fold edges. Each spacer member has its longitudinal axis in parallel relationsip to the longitudinal axes of the tubular conduits with the fin elements dividing the air passageway between the conduits into a plurality of smaller passageways. Each planar base member has a plurality of louvers therein, the louvers being integral with and extending laterally of the planar base members and arranged in groups having a support portion therebetween.

The improvement comprises the unitary strip of metal being very thin with a hem flange extending substantially the length of the strip through the support portions between groups of louvers. The hem flange forms a support column in each planar base member adapted to resist buckling in a direction transversely of the planar base member.

The unitary strip of metal has an average thickness of 0.001 to 0.0008 inches minimum and the hem flange thickness is approximately triple the average metal thickness.

7 Claims, 6 Drawing Figures

FIG. 1
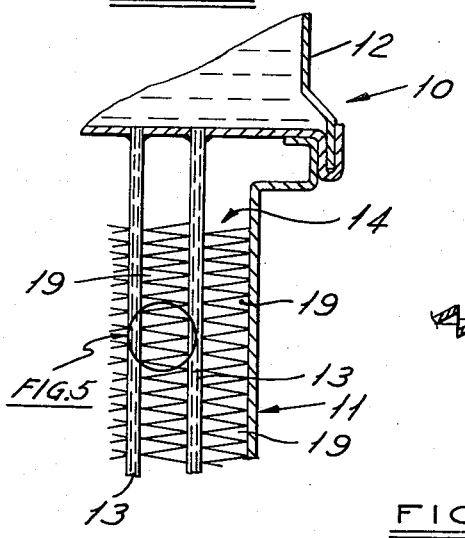
FIG. 6
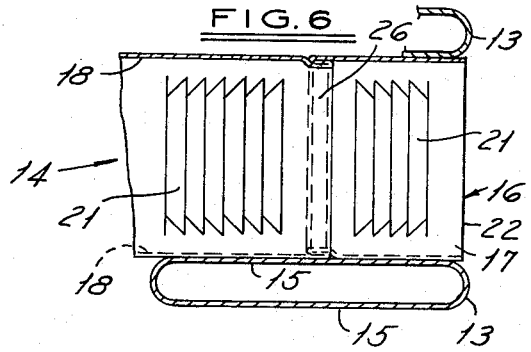
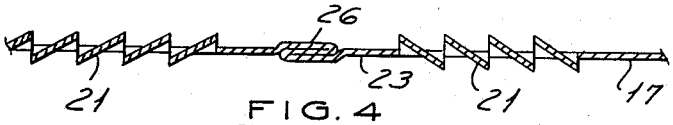
FIG. 4
FIG. 2
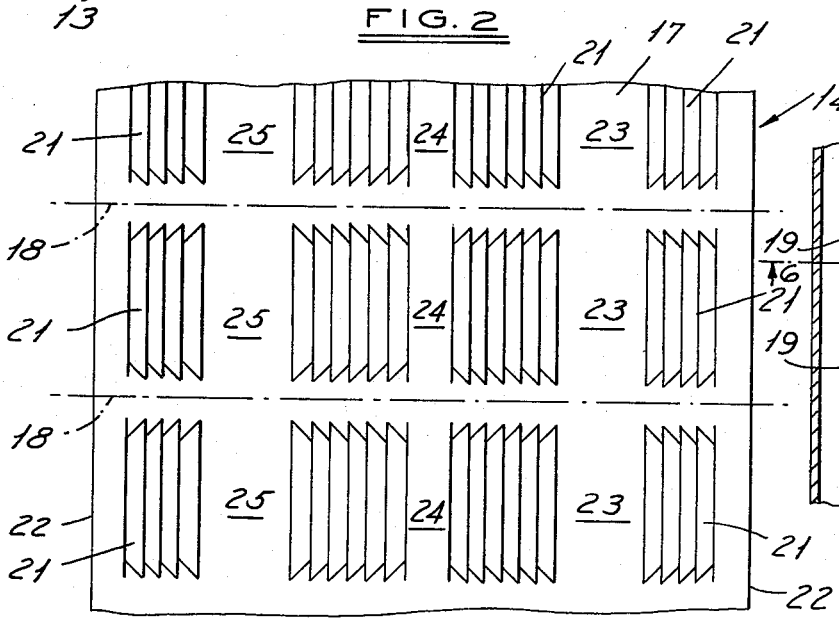
FIG. 5
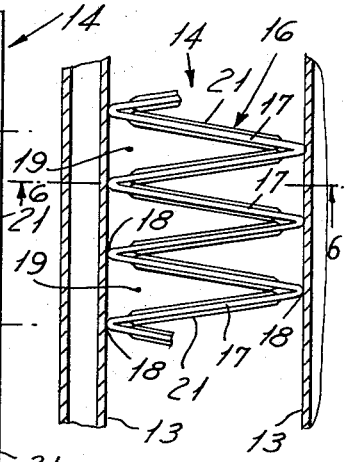
FIG. 3
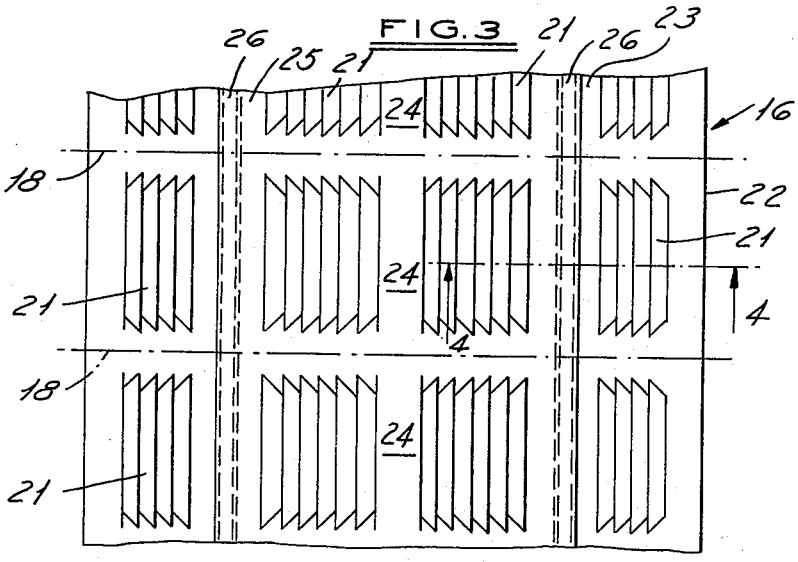

HEAT EXCHANGE DEVICE

BACKGROUND OF THE INVENTION

Rhodes et al., U.S. Pat. No. 3,250,325, is exemplary of a type of heat exchange device to which the improvement disclosed herein is directed.

This type of heat exchange device, such as a radiator for an internal combustion engine, has a plurality of parallel tubular conduits which extend between vessels or receptacles commonly called headers and through which engine coolant fluid flows. In contact with these tubes are heat exchange elements or spacers which present additional surface area to air passing between the tubes to accelerate heat removal from the tube surfaces. As shown in U.S. Pat. No. 3,250,325, the heat exchange elements or spaces may take the form of corrugated metal strips positioned between and soldered to adjacent tubular conduits. Each corrugation or fold comprises a planar base member which is slitted with metal turned out of the plane of the planar base to form a plurality of louvers.

It has been the objective of the heat exchanger manufacturing industry to produce the most efficient fin design with the minimum amount of material thus achieving a reduction in fabrication cost for a given capacity heat exchange structure. For example, the present gage of fin material used in production radiators for automobiles is 0.0022 minimum.

U.S. Pat. No. 1,257,201, issued Feb. 19, 1918, to C. A. Eligh for "Method of Making Heat Radiating Fins" suggests that it is desirable, though not essential, that the edges of the fin strips be strengthened, which is preferably done by folding them over.

U.S. Pat. No. 3,191,418 to Arthur M. Modine, issued June 29, 1965 for "Method and Apparatus Forming Serpentine Fins" suggests that the thickness of each fin be varied from 0.0024 at the conduit attachment portions to 0.0015 at the center of the fin between the conduits.

Attempts to use even thinner materials in the production of vehicle radiators have not been successful in producing a fin assembly capable of withstanding high stress concentrations within the radiator core. As a result, the fins are subjected to stresses that cause buckling and consequent interference with air flow through the fins.

It is an object of the present invention to permit the use of fin material having a thickness of 0.001 to 0.0008 inches minimum by providing a hem flange located at the highest stress point of the fin assembly thus forming a support column preventing the fin element from buckling.

SUMMARY OF THE INVENTION

The present invention relates to a heat exchange device having a vessel and heat transfer core means, the latter including at least two tubular conduits in fluid communication with the vessel. The tubular conduits are spaced apart to form an air passageway therebetween. A spacer member is positioned between and in heat exchange relationship with the tubular conduits. The spacer member comprises a unitary strip of metal folded back and forth to form a plurality of fin elements each having an essentially planar base member between the fold edges. Each spacer member has its longitudinal axis in parallel relationship to the longitudinal axes of the tubular conduits with the fin elements dividing the air passageway between the conduits into a plurality of smaller passageways. Each planar base member has a plurality of louvers therein, the louvers being integral with and extending laterally of the planar base members and arranged in groups having a support portion therebetween.

The improvement comprises the unitary strip of metal being of very thin metal with a hem flange extending substantially the length of the strip through the support portions between groups of louvers. The end flange forms a support column in each planar base member adapted to resist buckling of the latter in a transverse direction. The utilization of the hem flange permits use of a unitary strip of metal having an average thickness of 0.0010 to 0.0008 inches minimum with the hem flange thickness being approximately triple the average middle thickness of the strip.

DESCRIPTION OF THE DRAWING

Further features and advantages of the present invention will be made more apparent as this description proceeds, reference being had to the accompanying drawing, wherein:

FIG. 1 is a partial view of a heat exchange device of the type to which the present invention is applicable;

FIG. 2 is a view of a strip having groups of louvers formed in its surface;

FIG. 3 is a view of the strip shown in FIG. 2 after its width has been reduced by the formation of the hem flanges between spaced groups of louvers;

FIG. 4 is a sectional view on the line 4—4 of FIG. 3;

FIG. 5 is an enlarged view of a portion of the tube and fin structure shown in FIG. 1; and FIG. 6 is a sectional view on the line 6—6 of FIG. 5.

DETAILED DESCRIPTION OF THE INVENTION

As was described in Rhodes et al., U.S. Pat. No. 3,250,325, the radiator assembly, generally designated 10, comprises a heat dissipating unit or core 11 having at opposite ends a top vessel or inlet header 12 and a bottom tank or outlet header (not shown) adapted for connection, respectively, with intake and discharge conduits connected, for example, to a vehicle engine cylinder block cooling jacket (not shown). For the flow of cooling medium from one header to the other the core is made up of a number of tubular conduits 13 spaced apart by spacer members or fin strips 14. The tubular conduits 13 are of a non-circular type being of an elongated cross section with the long walls or sides 15 thereof parallel to each other, see FIG. 6.

The spacer members or fin strips 14 comprise a unitary strip of metal of folded or corrugated outline providing a series or plurality of angularly related fin elements 16 each having an essentially planar base member 17 between the connections or fold edges 18. The spacer member or fin strip 14 extends between adjacent walls 15 of adjacent conduits 13 in heat exchange relationship with the conduits. Each spacer member or fin strip 14 has its longitudinal axis in parallel relationship to the longitudinal axes of the tubular conduits 13 between which it is positioned to divide the air passageways between the conduits 13 into a plurality of smaller air passageways 19.

Each planar base member 17 has a plurality of louvers 21 therein through which air can pass from one air passageway 19 to another air passageway 19. The louvers are integral with and extend across the planar base member 17 in parallel relationship to the side edges 22 of the strip. It will be noted that the side edges 22 parallel the longitudinal axis of the spacer member or strip 14. The louvers 21 are arranged in groups having support portions indicated at 23, 24 and 25 in FIG. 2 between the groups of louvers 21 with the support portions paralleling the strip side edges 22.

Referring now to FIG. 2, the spacer member or fin strip 14 is shown after the louvers 21 have been formed therein but prior to the strip being corrugated or folded. It will be noted that the support portions 23 and 25 between groups of louvers 21 are substantially wider than the support portion 24 located substantially at the center of the strip 14. The reason for this is best seen with reference to FIGS. 3 and 4. In FIG. 3 the strip 14 is shown reduced in width between the side edges 22 as the result of the metal in the support portions being folded to form longitudinally extending hem flanges 26. As best seen in cross section in FIG. 4, the hem flange preferably is created by folding the metal of the strip into a triple layer. The hem flange 26 extends the length of the strip 14 through the support portions 23 and 25.

After the hem flanges have been formed in the strip, the latter may be corrugated or folded as detailed more fully in U.S. Pat. No. 3,250,325.

The strip 14 is assembled to the tubes 13 in the radiator core in a conventional manner.

As shown in FIG. 3, the strip 14 is of a width great enough to be positioned relative to two rows of tubular conduits 13, only one row and half a strip 14 being showed in FIG. 6. An important relationship that must be observed, however, is the placement of the hem flange 26 substantially centrally of the long sides 15 of the tubular conduits 13. It is the central area of the tubular conduits in which the expansion of the tubes because of high temperature fluid flowing therethrough causes the planar base member 17 of the fin elements to be placed under compression in the plane of the base members. Hem flange 26 forms a support column in each planar base member 17 which is adapted to resist buckling of the latter in a direction paralleling the side edges and therefore the longitudinal axis of the strip.

The provision of the hem flanges 26 permits the use of spacer members or fin strips 14 requiring a minimal amount of material thus achieving a reduction in fabrication cost and weight for a given capacity heat exchange structure. Current production radiators for use in liquid cooled engines for automotive vehicles have spacer members or fin strips fabricated of 0.0022 inches minimum gage or thickness. Spacer members or fin strips embodying the hem flanges may be fabricated of very thin metal of 0.001 to 0.0008 inches minimum or less than half the thickness of current production material. This is a result that cannot be achieved by merely hem flanging the side edges of the spacer members or fin strips as disclosed in the aforementioned U.S. Pat. No. 1,257,201 since the side edges of the fin strips are not located at the highest stress point of the assembly.

Perhaps it should be explained that the reason the metal gage for the metal from which the fin strips are formed is specified as a minimum dimension is that the metal is purchased on a weight basis. The thicker the strip material, obviously the more it costs. The material may not have a thickness less than the specified minimum since it would be structurally unsuited for use as fin strip material. Although a thickness of 10 percent above the minimum is permitted, the supplier able to come closest to the desired minimum is usually given preference, all other things being equal.

The present invention permits the production of a most efficient fin design with the use of the minimum amount of material thus achieving a reduction in fabrication cost for a given capacity heat exchange structure.

It is to be understood this invention is not limited to the construction illustrated and described above, but that various changes and modifications may be made without departing from the spirit and scope of the invention as defined by the following claims.

I claim:

1. A heat exchange device having a vessel and heat transfer core means including at least two tubular conduits in fluid communication with the vessel, the tubular conduits being spaced apart to form an air passageway therebetween, and a spacer member between and in heat exchange relationship with said tubular conduits, the spacer member comprising a unitary strip of metal folded back and forth to form a plurality of fin elements each having an essentially planar base member between the fold edges, each spacer member having its longitudinal axis in parallel relationship to the longitudinal axes of the tubular conduits with the fin elements dividing the air passageway into a plurality of smaller passageways, each planar base member having a plurality of louvers therein, the louvers being integral with and extending laterally of the planar base members and arranged in groups having a support portion therebetween, wherein the improvement comprises the unitary strip being of very thin metal with a hem flange extending substantially the length of the strip through the support portions between groups of louvers, the hem flange forming a support column in each planar base member adapted to resist buckling of the latter in a direction transversely thereof.

2. A heat exchange device according to claim 1, in which:

the unitary strip of metal has an average thickness of 0.0010 to 0.0008 inches minimum and the hem flange thickness is approximately triple the average metal thickness.

3. A heat exchange device having a vessel and heat transfer core means including a plurality of tubular conduits in fluid communication with the vessel, the tubular conduits being of elongated cross section arranged with the long sides thereof parallel to each other, the tubular conduits being spaced apart to form air passageways therebetween, and spacer members positioned between and secured to facing surfaces of each pair of tubular conduits in heat exchange relationship therewith, the spacer members each comprising a unitary strip of metal folded back and forth to form a plurality of angularly related fin elements each having an essentially planar base member between the edge connections, each spacer member having its longitudinal axis in parallel relationship with the longitudinal axes of the tubular conduits between which it is positioned with its fin elements dividing the air passageway into a plurality of smaller passageways, each planar base member having a plurality of louvers therein, the louvers being integral with and extending across the planar base members in parallel relationship to the longitudinal axis of the strip, the louvers being arranged in groups having support portions therebetween, the strip of metal having a hem flange extending the length of the strip through the support portion between groups of louvers, the hem flange forming a support column in each planar base member adapted to resist buckling of the latter in a direction paralleling the longitudinal axis of the strip.

4. A heat exchange device according to claim 3, in which:

the unitary strip foil thickness is in the range of 0.001 to 0.0008 minimum and the hem thickness is in the range of 0.003 to 0.0024 minimum.

5. A heat exchange device according to claim 4, in which:

the hem flange is located substantially centrally of the long sides of the pair of tubular conduits to which the strip is secured.

6. A heat exchange device according to claim 3, in which:

the hem flange is located substantially centrally of the long sides of the pair of tubular conduits to which the respective strip is secured.

7. A spacer member adapted to be positioned between and secured to the side walls of a pair of parallel tubular conduits of elongated cross section having an air passageway therebetween, the spacer member reducing the air passageway into a plurality of smaller passageways, the spacer member comprising a unitary strip of thin metal having an average thickness of 0.0010 to 0.0008 inches minimum, the strip having parallel side edges and being folded into a corrugated form to provide a plurality of angularly related fin elements extending lengthwise of the strip, each fin element having an essentially planar base member between its edges connecting it to adjacent fin elements, each planar base member having a plurality of louvers therein with the louvers being integral with and extending across the planar base members in parallel relationship to the side edges of the strip, the strip having a hem flange extending its length through support portions between groups of louvers, the hem flange paralleling the side edges of the strip and forming a support column capable of resisting buckling of the fin elements transversely of the fin element edges.

* * * * *